US005496011A

United States Patent [19]

Samargo et al.

[11] Patent Number: 5,496,011

[45] Date of Patent: Mar. 5, 1996

[54] CONTAINER DISPENSING VALVE

[76] Inventors: Daniel L. Samargo; Patty S. Samargo, both of P.O. Box 617, Rivesville, W. Va. 26588

[21] Appl. No.: 376,925

[22] Filed: Jan. 23, 1995

[51] Int. Cl.[6] ..... F16K 31/44

[52] U.S. Cl. ..... 251/246; 222/563

[58] Field of Search ..... 251/244, 245, 251/246; 222/563

[56] References Cited

U.S. PATENT DOCUMENTS 2,302,306 11/1942 Faast ..... 251/246

2,346,929 12/1944 Trott ..... 251/246

4,752,018 6/1988 Rudick et al. ..... 251/246

*Primary Examiner*—A. Michael Chambers

[57] ABSTRACT

A valve for selectively dispensing contents of a bottle. The inventive device includes a mounting cap securable to a threaded neck of a bottle. A valve assembly is coupled to the mounting cap and can be selectively operated by an actuating assembly to effect dispensing of the contents of the bottle. The actuating assembly includes a lever arm extending proximal to the bottle for facilitating operation of the valve assembly with a single hand.

2 Claims, 4 Drawing Sheets

CONTAINER DISPENSING VALVE

BACKGROUND OF THE INVENTION

1. Field of the Invention

The present invention relates to valve structures and more particularly pertains to a container dispensing valve for selectively dispensing contents of a bottle.

2. Description of the Prior Art

The use of valve structures is known in the prior art. More specifically, valve structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art valve structures include U.S. Pat. No. 5,249,611; U.S. Pat. No. 5,193,719; U.S. Pat. No. 5,107,909; U.S. Pat. No. 5,042,698; and U.S. Pat. No. 4,446,989.

While these devices fulfill their respective, particular objectives and requirements, the aforementioned patents do not disclose a container dispensing valve for selectively dispensing contents of a bottle which includes a mounting cap securable to a threaded neck of the bottle, a valve assembly coupled to the mounting cap which can be selectively operated by an actuating assembly to effect dispensing of the contents of the bottle, wherein the actuating assembly includes a lever arm extending proximal to the bottle for facilitating operation of the valve assembly with a single hand.

In these respects, the container dispensing valve according to the present invention substantially departs from the conventional concepts and designs of the prior art, and in so doing provides an apparatus primarily developed for the purpose of selectively dispensing the contents of a bottle.

SUMMARY OF THE INVENTION

In view of the foregoing disadvantages inherent in the known types of valve structures now present in the prior art, the present invention provides a new container dispensing valve construction wherein the same can be utilized for selectively dispensing contents of a bottle. As such, the general purpose of the present invention, which will be described subsequently in greater detail, is to provide a new container dispensing valve apparatus and method which has many of the advantages of the valve structures mentioned heretofore and many novel features that result in a container dispensing valve which is not anticipated, rendered obvious, suggested, or even implied by any of the prior art valve structures, either alone or in any combination thereof.

To attain this, the present invention generally comprises a valve for selectively dispensing contents of a bottle. The inventive device includes a mounting cap securable to a threaded neck of a bottle. A valve assembly is coupled to the mounting cap and can be selectively operated by an actuating assembly to effect dispensing of the contents of the bottle. The actuating assembly includes a lever arm extending proximal to the bottle for facilitating operation of the valve assembly with a single hand.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new container dispensing valve apparatus and method which has many of the advantages of the valve structures mentioned heretofore and many novel features that result in a container dispensing valve which is not anticipated, rendered obvious, suggested, or even implied by any of the prior art valve structures, either alone or in any combination thereof.

It is another object of the present invention to provide a new container dispensing valve which may be easily and efficiently manufactured and marketed.

It is a further object of the present invention to provide a new container dispensing valve which is of a durable and reliable construction.

An even further object of the present invention is to provide a new container dispensing valve which is susceptible of a low cost of manufacture with regard to both materials and labor, and which accordingly is then susceptible of low prices of sale to the consuming public, thereby making such container dispensing valves economically available to the buying public.

Still yet another object of the present invention is to provide a new container dispensing valve which provides in the apparatuses and methods of the prior art some of the advantages thereof, while simultaneously overcoming some of the disadvantages normally associated therewith.

Still another object of the present invention is to provide a new container dispensing valve for selectively dispensing contents of a bottle with a single hand.

Yet another object of the present invention is to provide a new container dispensing valve which includes a mounting cap securable to a threaded neck of the bottle, a valve assembly coupled to the mounting cap which can be selectively operated by an actuating assembly to effect dispensing of the contents of the bottle.

Even still another object of the present invention is to provide a new container dispensing valve wherein the actuating assembly includes a lever arm extending proximal to the bottle for facilitating operation of the valve assembly with a single hand.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
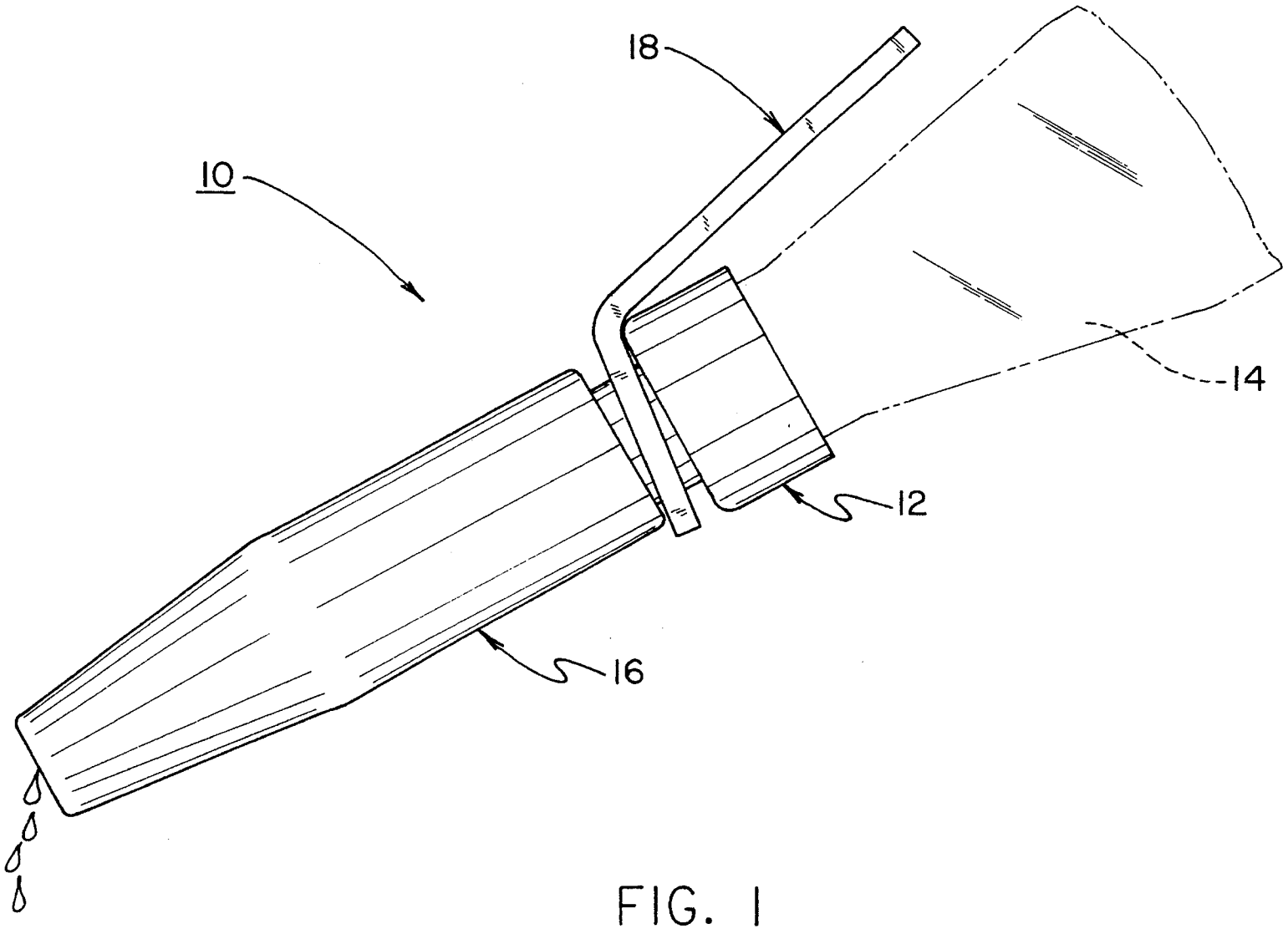
FIG. 1 is a side elevation view of a container dispensing valve according to the present invention in use.
Figure 3:
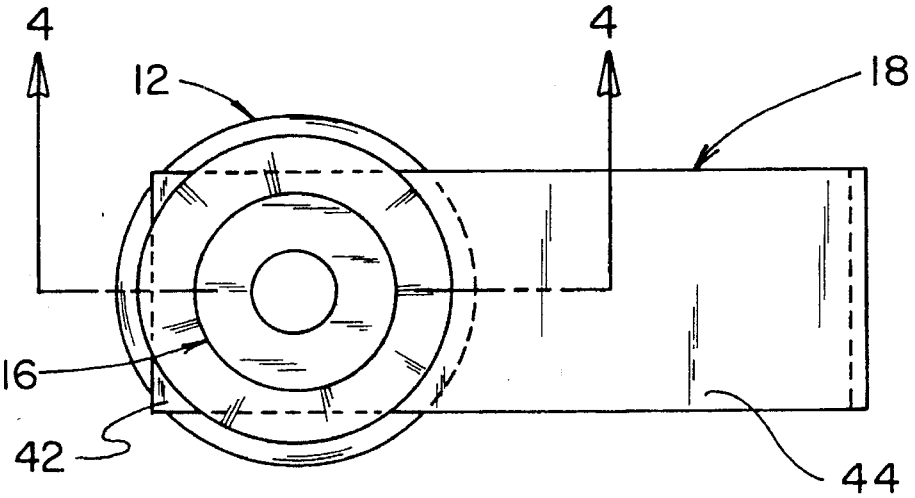
FIG. 3 is an end elevation view taken from line 3—3 of FIG. 1.
Figure 2:
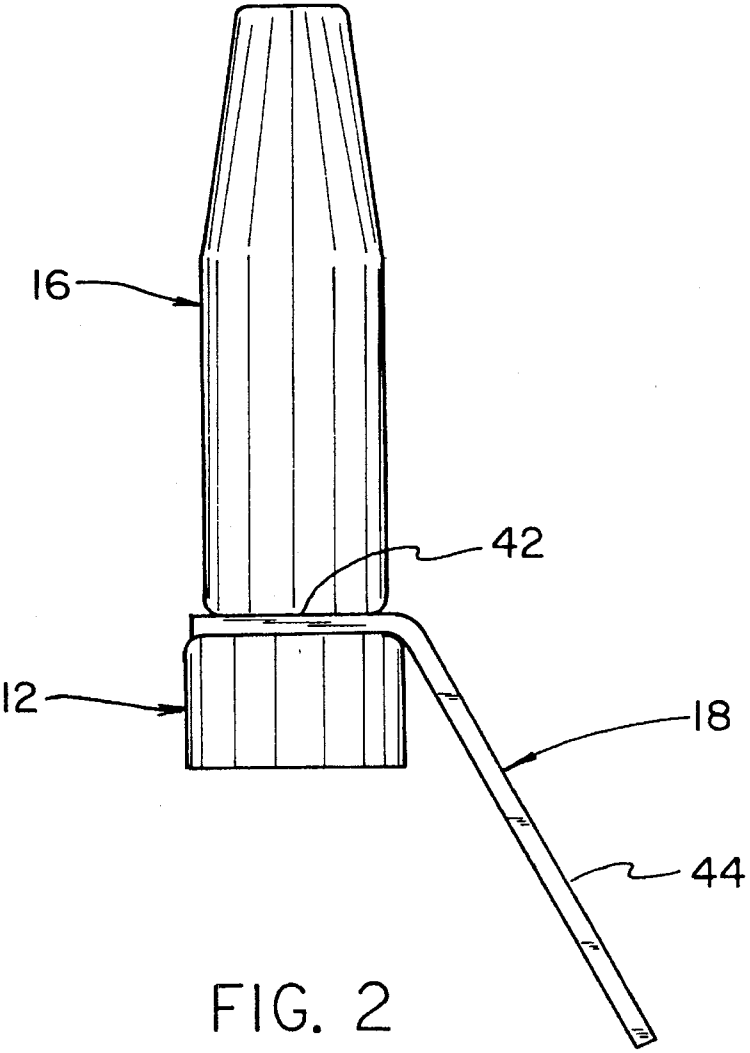
FIG. 2 is a side elevation view of the invention, per se.

With reference now to the drawings, and in particular to FIGS. 1–6 thereof, a new container dispensing valve embodying the principles and concepts of the present invention and generally designated by the reference numeral 10 will be described.

More specifically, it will be noted that the container dispensing valve 10 comprises a mounting means 12 for securing to an unlabelled threaded neck of a container 14, as shown in FIG. 1. A valve means 16 is coupled to the mounting means 12 and positioned so as to be in fluid communication with the container 14 when the mounting means 12 is coupled thereto for selectively dispensing contents of the container. An actuator means 18 is movably mounted to the mounting means 12 for selectively actuating the valve means 16. The container dispensing valve 10 can thus be operated to dispense the contents of the container 14 through the valve means 16 as desired.

As best illustrated in FIGS. 3 through 6, it can be shown that the mounting means 12 according to the present invention 10 comprises a threaded cap 20 having interior threads cooperable with exterior threads of the unlabelled container neck of the container 14. The threaded cap 20 is provided with an aperture through which a central tube 22 of the valve means 16 projects.

Figure 4:
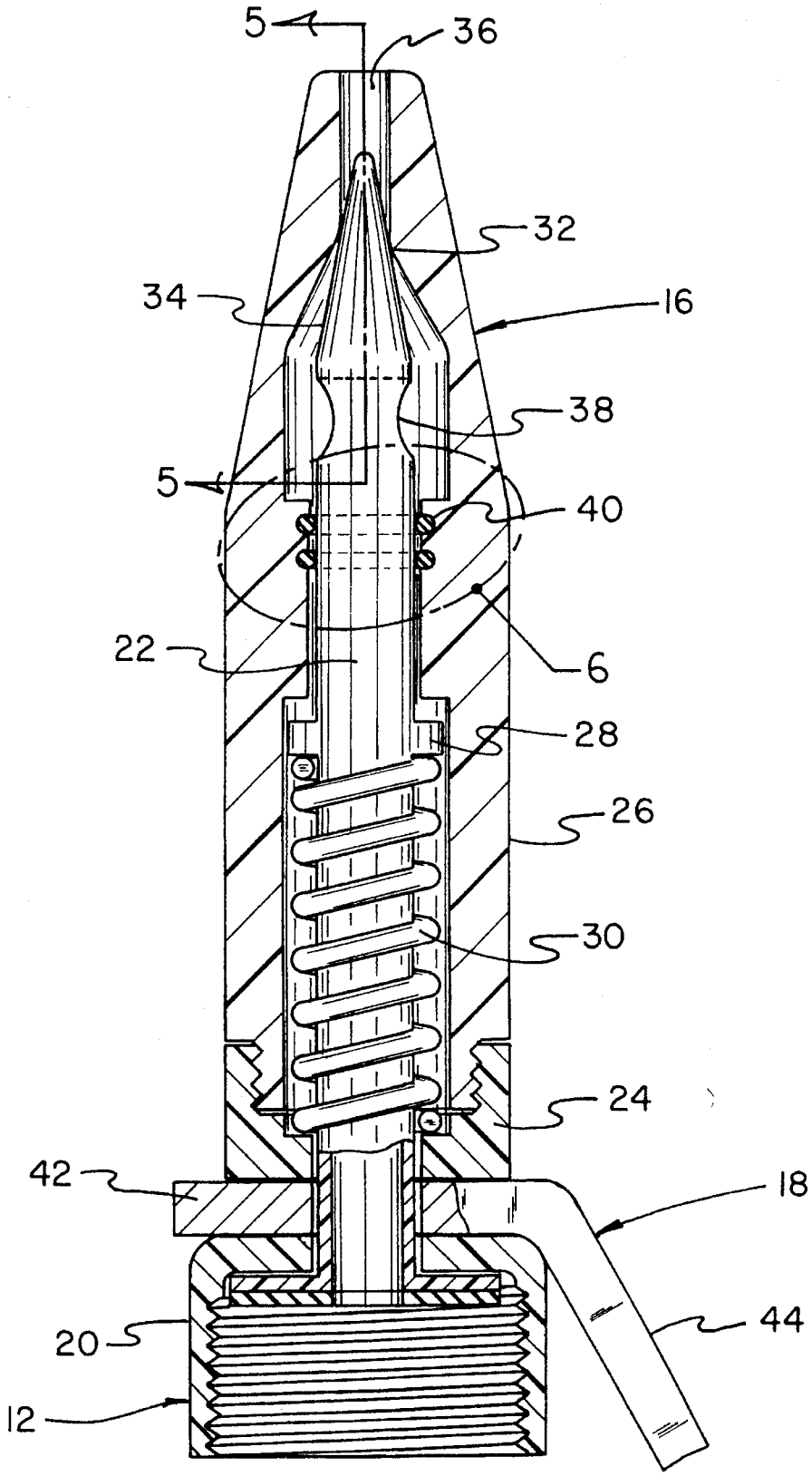
FIG. 4 is a cross-sectional view taken along line 4—4 of FIG. 2.

With continuing reference to FIG. 4, it can be shown that the valve means 16 comprises the central tube 22 which projects through the aperture and the threaded cap 20 so as to be positioned for sealing engagement against the neck of the container 14. The central tube 22 is substantially hollow in configuration so as to permit a passage of the contents of the container 14 therethrough in a manner which will subsequently be described in more detail. The valve means 16 further comprises a base member 24 having a central aperture extending therethrough positioned about the central tube 22 such that the central tube projects through the central aperture thereof. A nozzle 26 is removably coupled to the base member 24 so as to extend over the central tube 22 substantially as shown. The central tube 22 includes a radially projecting flange 28 which cooperates with an interior surface of the base member 24 to capture a coil spring 30 between the flange and the interior surface of the base member. The coil spring 30 thus biases the base member 24 towards the threaded cap 20 to maintain the nozzle 26 over the central tube 22.

Figure 5:
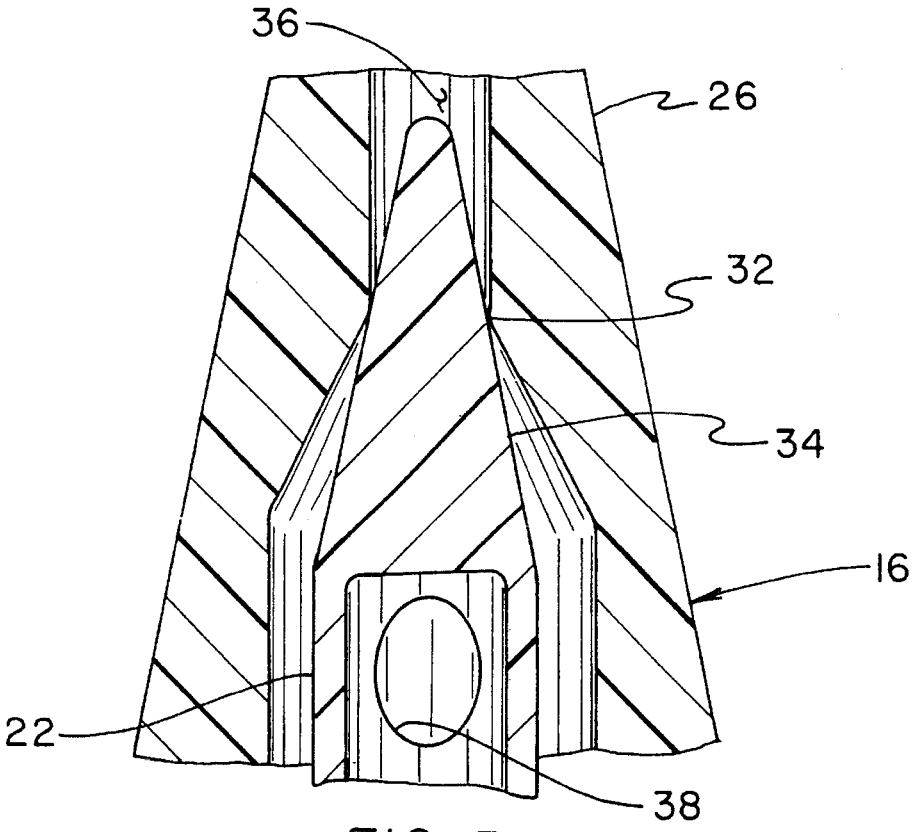
FIG. 5 is a cross-sectional view taken along line 5—5 of FIG. 4.
Figure 6:
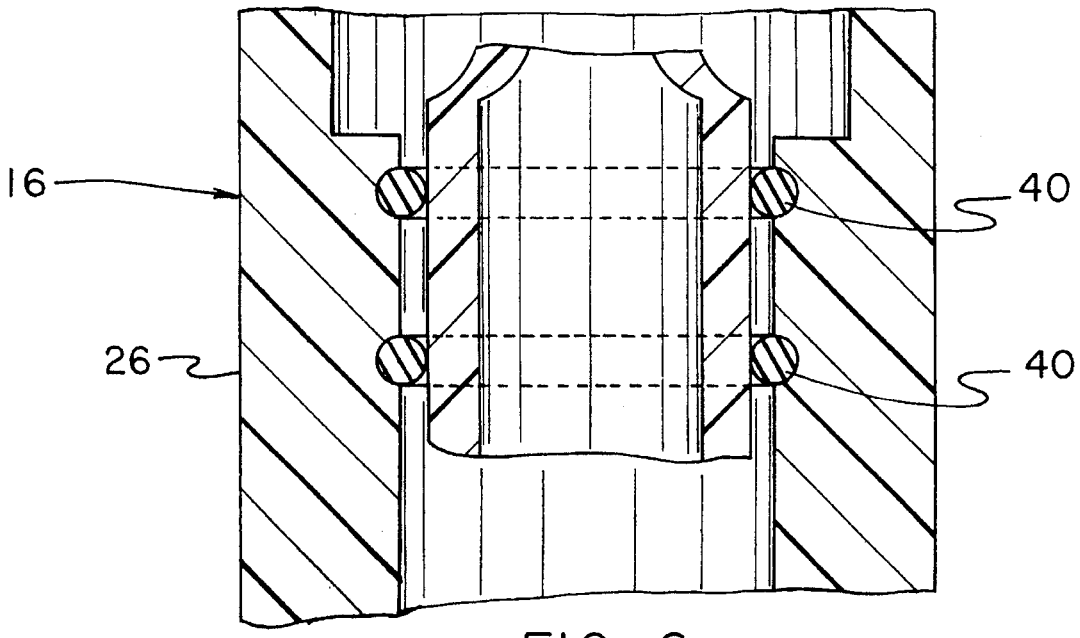
FIG. 6 is an enlarged cross section of the area set forth in FIG. 4.

As best illustrated in FIG. 5, it can be shown that the nozzle 26 is shaped so as to define a valve seat 32 of reduced cross-sectional dimension which engages a needle point valve 34 of the central tube 22. The valve seat 32 continues into an exit aperture 36 through which the contents of the bottle 14 can be dispensed. The needle point valve 34 is substantially conical in shape and engages the valve seat 32 of the nozzle 26 to preclude fluid communication through the exit aperture 36. The central tube 22 includes a plurality of apertures 38 extending therethrough which permit the contents of the bottle 14 to exit from the hollow interior of the central tube 22 for passage through the exit aperture 36 when the valve seat 32 is biased from the needle point valve 34 of the central tube 22. A pair of seals 40 are mounted within unlabelled grooves circumferentially extending about an interior surface of the nozzle 26 which engage an exterior surface of the central tube 22 to preclude fluid communication of the contents of the bottle 14 into contact with the coil spring 30. The seals 40, as shown in FIG. 6, preferably comprise O-ring seals commonly available to facilitate easy replacement thereof during use of the device 10.

To selectively move the nozzle 26 relative to the central tube 22 so as to bias the valve seat 32 from the needle point valve 34, the actuator means 18 of the present invention 10 preferably comprises an abutment plate 42 having a through-extending central aperture interposed between the threaded cap 20 and the base member 24. A lever arm 44 of the actuator means 18 extends from the abutment plate 42 at an oblique angle relative thereto so as to extend proximal to a side wall of the container 14 when the device is coupled to the container as shown in FIG. 1. Thus, an actuation of the lever arm 44 either towards or away from the container 14 will result in a pivoting of the abutment plate 42 relative to the threaded cap 20 to effect biasing of the base member 24 and the nozzle 26 coupled thereto away from the threaded cap. Because the central tube 22 is coupled to the threaded cap 20, the nozzle 26 will thus be biased relative to the central tube 22 against a force of the coil spring 30. Such biasing of the base member 24 and the associated nozzle 26 from the threaded cap 20 will effect spacing of the valve seat 32 from the needle point valve 34 of the central tube 22 to permit dispensing of the contents of the bottle 14 through the lateral apertures 38 and out of the exit aperture 36 of the nozzle.

In use, the container dispensing valve 10 according to the present invention can be utilized to dispense contents of a container 14 in a controlled and articulated manner. The device 10 permits an individual to utilize a single hand during operation of the valve means 16 in dispensing contents from the bottle. The device may be configured to attach to any conventionally known container 14 such as oil bottles, dishwashing liquid bottles, shampoo bottles, lotion bottles, syrup bottles, or the like. The device 10 also serves to reduce contact of an individual relative to the nozzle 26 which could contaminate fluids contained within the container 14.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A container dispensing valve comprising: a mounting means for securing to a neck of a container, the mounting means comprising a cap being securable to a neck of the container, the cap including an aperture directed therethrough; a valve means coupled to the mounting means for selectively permitting dispensing of the contents of the container, the valve means comprising a central tube projecting through the aperture of the cap; and an actuator means movably mounted to the mounting means for selectively actuating the valve means the central tube is positionable for sealing engagement against a neck of a container to which the mounting means is attachable, the central tube being substantially hollow; a base member and a central aperture extending therethrough are positioned about the central tube such that the central tube projects through the central aperture thereof; a nozzle removably coupled to the base member so as to extend concentrically over the central tube, the central tube including a radially projecting flange; a coil spring interposed between the flange and an interior surface of the base member so as to biases the base member towards the cap to maintain the nozzle over the central tube, the nozzle being shaped so as to define a valve seat of reduced cross-sectional dimension continuing into contiguous communication with an exit aperture thereof, the central tube being shaped so as to define a needle point valve engaging the valve seat of the nozzle and a plurality of lateral apertures extending therethrough, wherein the nozzle can be selectively moved relative to the central tube so as to bias the valve seat from the needle point valve.

2. The container dispensing valve of claim 1, wherein the actuator means comprises an abutment plate having a through-extending central aperture and being interposed between the cap and the base member; a lever arm extending from the abutment plate at an oblique angle relative thereto, whereby an pivoting of the lever arm relative relative to the cap will result in a pivoting of the abutment plate 42 relative to the cap to effect biasing of the base member and the nozzle coupled thereto away from the threaded cap so as to cause a spacing of the valve seat from the needle point valve of the central tube to permit dispensing of contents of a bottle through the lateral apertures of the central tube and out of the exit aperture of the nozzle.

* * * * *